US009687723B2

(12) United States Patent
Maier

(10) Patent No.: US 9,687,723 B2
(45) Date of Patent: Jun. 27, 2017

(54) CYCLING SUIT WITH A SEAT PAD

(71) Applicant: ASSOS OF SWITZERLAND S.A., San Pietro di Stabio (CH)

(72) Inventor: Roger Maier, Carona (CH)

(73) Assignee: ASSOS OF SWITZERLAND S.A., San Pietro di Stabio (CH)

( * ) Notice: Subject to any disclaimer, the term of this patent is extended or adjusted under 35 U.S.C. 154(b) by 85 days.

(21) Appl. No.: 14/295,386

(22) Filed: Jun. 4, 2014

(65) Prior Publication Data

US 2014/0359925 A1 Dec. 11, 2014

(30) Foreign Application Priority Data

Jun. 5, 2013 (EP) ..... 13170698

(51) Int. Cl.

| | |
|---|---|
| ***A63B 71/00*** | (2006.01) |
| ***A63B 71/12*** | (2006.01) |
| ***A41D 1/08*** | (2006.01) |
| ***A41D 13/05*** | (2006.01) |
| ***A41H 43/00*** | (2006.01) |

(52) U.S. Cl.

CPC ..... *A63B 71/1216* (2013.01); *A41D 1/084* (2013.01); *A41D 13/0525* (2013.01); *A41H 43/00* (2013.01)

(58) Field of Classification Search

CPC . A41D 1/06; A41D 1/08; A41D 1/084; A41D 1/088; A41D 13/0525; A41D 13/0015; A41D 13/00; A41D 13/015; A41D 13/0002; A63B 71/1216; A63B 71/12; A41B 9/02; A41B 9/004; A41B 9/005; A41H 43/00

USPC ..... 2/466, 227, 228, 401, 78.1, 79

See application file for complete search history.

(56) References Cited

U.S. PATENT DOCUMENTS

| | | | | |
|---|---|---|---|---|
| 4,945,571 | A * | 8/1990 | Calvert | 2/467 |
| 7,707,659 | B2 * | 5/2010 | Africa et al. | 2/267 |
| 2003/0056282 | A1 * | 3/2003 | Coccia | 2/466 |
| 2004/0143890 | A1 | 7/2004 | Reschewitz | |
| 2005/0066423 | A1 * | 3/2005 | Hogan | 2/227 |
| 2005/0210570 | A1 * | 9/2005 | Garneau | 2/466 |
| 2005/0223478 | A1 * | 10/2005 | Hogan | 2/466 |
| 2007/0174953 | A1 * | 8/2007 | Garneau | 2/466 |
| 2007/0226869 | A1 * | 10/2007 | Maier | 2/69 |
| 2008/0229486 | A1 * | 9/2008 | Maier | 2/401 |
| 2009/0113598 | A1 * | 5/2009 | Maier | 2/79 |

(Continued)

FOREIGN PATENT DOCUMENTS

| | | |
|---|---|---|
| CH | 702 218 B1 | 5/2011 |
| DE | 8905746 U1 | 6/1989 |

(Continued)

OTHER PUBLICATIONS

Screenshot from www.sugoi-japan.com dated Mar. 7, 2011.

(Continued)

*Primary Examiner* — Khaled Annis

(74) *Attorney, Agent, or Firm* — Fox Rothschild LLP

(57) ABSTRACT

A cycling suit (1) comprises a seat pad (2) located in a crotch area; the seat pad comprises a cover (3) and a padding (4); the cover (3) comprises three-layer structure with a first layer, an outer layer and an intermediate layer, and a front portion (5) of the cover is formed with an insert (10) of a single-layer skin contact textile.

7 Claims, 2 Drawing Sheets

(56) References Cited

U.S. PATENT DOCUMENTS

| | | | | |
|---|---|---|---|---|
| 2010/0095432 | A1 | 4/2010 | Liou | |
| 2010/0095442 | A1* | 4/2010 | Kuipers | 2/466 |
| 2012/0005813 | A1* | 1/2012 | Lambertz | 2/466 |
| 2013/0000025 | A1 | 1/2013 | Garneau | |
| 2014/0359926 | A1* | 12/2014 | Maier | 2/466 |
| 2014/0366254 | A1* | 12/2014 | Maier | 2/466 |

FOREIGN PATENT DOCUMENTS

| | | |
|---|---|---|
| DE | 20211311 | 12/2003 |
| EP | 0 776 615 A2 | 6/1997 |
| EP | 1972216 | 9/2008 |
| WO | 0219852 A2 | 3/2002 |

OTHER PUBLICATIONS

Catalogue from Sugoi spring 2012.
Pages from http://www.bikeradar.com accessed Mar. 3, 2016.
Pages from http://www.atwistedspoke.com accessed Mar. 3, 2016.
Images of Sugoi Catalogue 2010 retrieved from https://issuu.com accessed Mar. 3, 2016.
Images of Sugoi Catalogue 2011-2012 retrieved from https://issuu.com accessed on Mar. 3, 2016.
U.S. Appl. No. 61/351,352, filed Jun. 4, 2010.
Declaration of Ms. Grespan (Italian language), English Translation and pciture of seat pad publicly disclosed Oct. 2012.
Declaration of Mr. Zantedeschi (Italian) and English translation publicly disclosed Oct. 2012.
Declaration of Mr. Viola (Italian) and English translation publicly disclosed Oct. 2012.

* cited by examiner

CYCLING SUIT WITH A SEAT PAD

CROSS REFERENCE TO RELATED APPLICATIONS

This US Application claims priority to European Application No.: 13170698, filed Jun. 5, 2013, entitled "A CYCLING SUIT WITH A SEAT PAD" the entirety of which is incorporated herein by reference.

FIELD OF THE INVENTION

The invention relates to the field of cycling sport suits. The invention relates in particular to a cycling suit including a seat pad in the crotch area, and to a seat pad for the making of a cycling suit.

PRIOR ART

It is a known technique to provide cycling suits with a seat pad for a better protection and comfort of body parts in contact with the saddle of the bicycle.

The seat pad may comprise a soft fabric piece, which is also termed cover, and a padding. The cover is fixed to the suit, for example by sewing, gluing or welding or another technique. The padding is normally in the form of two or more shaped pads fixed to said cover or to the cycling suit.

According to known art, the cover has commonly a multi-layered structure, for example including a layer of a soft expanded material sandwiched between two fabric layers.

There is a continuous effort to improve the performance and comfort of the seat pad, especially under intensive use, to meet the expectations of the users. It has been noted in this respect that the parts of the seat pad or of the cycling suit in contact with the genitals are of crucial importance. A proper support as well as a good thermal condition of the genital area in fact is crucial for comfort. In particular, the male genitals need a proper accommodation and efforts have been made to provide specialized embodiment of the seat pad for this purpose.

Hence, a particular care has been dedicated to improve the comfort for the genitals of the user.

EP-A-1972216, for example, discloses a cycling suit with anatomically shaped seat pad to shield and support the male genitals, in particular the scrotal area.

EP-A-2514329 discloses a sleeve in the inner side of the crotch area, facing the body of the user to provide room for accommodation of the male genitals.

SUMMARY OF THE INVENTION

The invention is aimed to further improve the above prior art. The invention, in particular, is aimed to improve the comfort for the genitals, especially for a male user.

The basic idea underlying the invention is to provide a portion of the seat pad which is specially dedicated to comfort of the genitals and, according to a preferred use, to accommodation of the male genitals. In this portion, the conventional multi-layered structure is replaced by a single layer of a skin contact textile. The term of skin contact textile denotes a fabric material suitable for direct contact with the skin.

Accordingly, the aims of the invention are reached with a cycling suit comprising a seat pad located in a crotch area of the suit, where:

the seat pad comprises a cover made of a shaped soft fabric piece fixed to the cycling suit, said cover has a multi-layered structure comprising at least a first layer, facing the inside of the suit so that it is contact with the skin when the suit is worn, an outer layer opposite to said first layer, and an intermediate layer, characterized in that:

said cover of the seat pad has a front portion located to accommodate the genitals when the cycling suit is worn, which is made of a single-layer skin contact textile.

The multi-layered structure of the cover has normally three layers, including an intermediate layer sandwiched between an inner layer and an outer layer. The intermediate layer is normally made of a synthetic rubber foam, preferably perforated. The outer layer may also be perforated, according to a preferred embodiment of the invention.

Preferably, said front portion has a rounded shape.

In a preferred embodiment, a portion of the multi-layered cover is cut away and replaced with a suitable insert made of said skin contact textile.

The seat pad normally includes and a padding fixed to said cover or to the cycling suit.

The invention has the following advantages. The front portion of the cover, having a lighter structure than the rest of the seat pad, and with no foam, creates a sort of nest where the male genitals are properly stored. Furthermore, the single-layer front portion has a higher breathability than the rest of the seat pad and keeps the genitals cooler during intensive use.

The inventive seat pad combines the conventional multi-layered structure, usually with an intermediate foam layer, with a lighter insert which is strategically located in the front of the seat pad and in correspondence with the genitals. The conventional structure provides the necessary support and resistance, e.g. to properly support the paddings, and the dumping effect due to the foam layer, while the lighter insert improves the comfort and breathability for the genital area. Another advantage is the overall weight reduction for the seat pad.

Other aspects of the invention are a seat pad for a cycling suit and a method for making a seat pad according to the attached claims. In a preferred embodiment of the invention, a portion of the three-layered cover is cut away and replaced with a suitable insert made of said skin contact textile.

It should be noted that the term of cycling suit in this description and in the attached claims encompasses various items including at least a trouser portion having a crotch area, such as a bodysuit, a pair of trousers and the like.

The invention is now elucidated in a greater detail with the help of the following detailed description, which is given for indicative and not limiting purpose.

DETAILED DESCRIPTION

Figure 1:
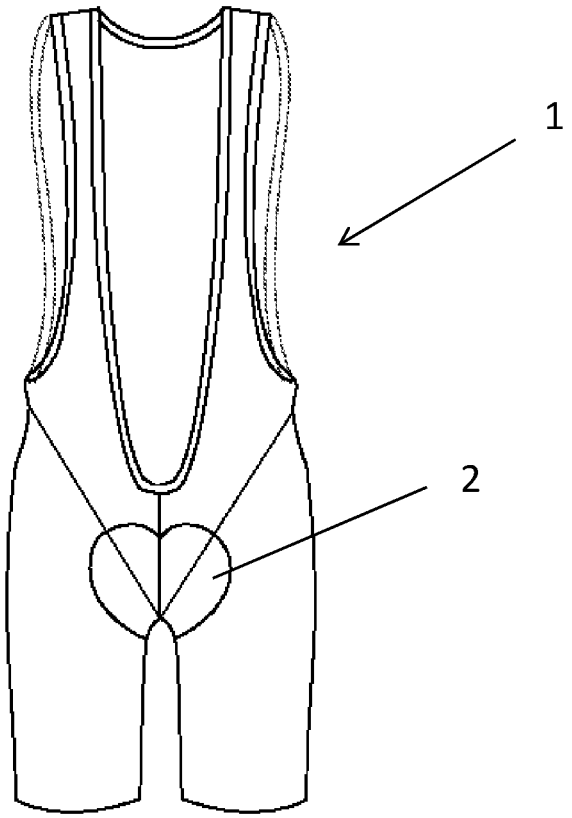
FIG. 1 is a view of a cycling suit according to an embodiment of the invention.

FIG. 1 shows a cycling suit 1 including a seat pad 2 in the crotch area. The cycling suit 1 is made of a suitable elastic fabric, such as Lycra, and may have different forms, such as a bodysuit, a pair of trousers, and others, according to various embodiments of the invention and the intended use, e.g. winter or summer, male or female, etc.

The seat pad 2 includes a soft fabric piece to form a cover 3. Said cover 3 is fixed (e.g. stitched) to the inside of the crotch area of the cycling suit 1. The seat pad 2 also comprises a suitable padding which for example includes a couple of pads 4 fixed to said cover 3.

Figure 2:
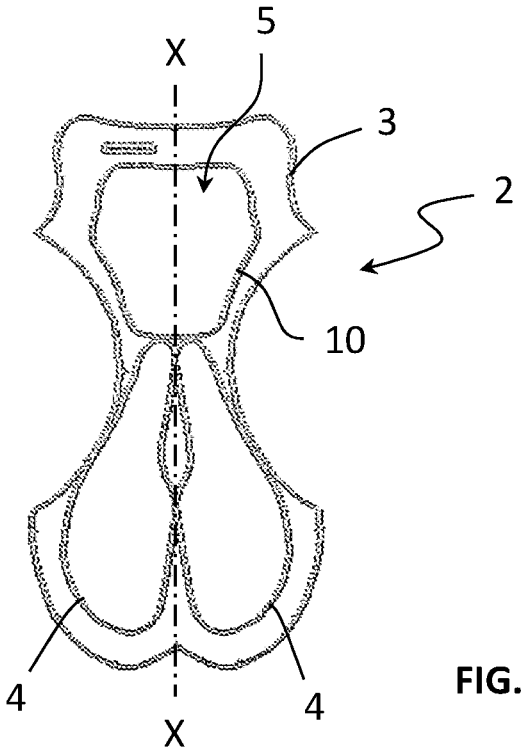
FIG. 2 is a top view of the seat pad of the cycling suit of FIG. 1. Central axis X divides the seat pad (2) into two substantially symmetrical sides. The front portion of the cover is substantially symmetrical along the central axis X.

FIG. 2 shows a typical shape of a seat pad; said pad 2 may have a concave shell in the front and/or rear portion.

Figure 3:
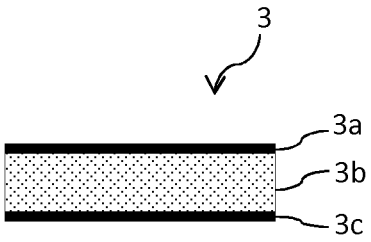
FIG. 3 is a cross section of the cover of a seat pad according to a preferred embodiment.

The cover 3 has generally a multi-layered structure, for example including: a first layer, an intermediate soft layer, and an outer layer. The intermediate layer is normally a layer of a synthetic foam rubber and is preferably perforated. FIG. 3 illustrates a cross section of a portion of cover 3 showing a first layer 3*a*, an intermediate soft layer 3*b* and an outer layer 3*c*.

Said cover 3 includes a front portion 5 which is made of a single-layer skin contact textile, instead of the above described three layers.

To this purpose, the process of manufacturing the seat pad may include the following basic steps:

the provision of said cover 3 having an inner layer, and intermediate layer an outer layer, cutting away a front portion of said cover 3, leaving an aperture in the seat pad, and providing an insert 10 of a skin contact textile over said aperture, fixing said insert to the cover 3.

Said insert 10 can be fixed to the rest of the cover 3 with any technique such as stitching, gluing or thermal welding. The insert 10 is made e.g. of nylon or Lycra, polyester or a combination thereof.

It may be appreciated that: the middle and rear portions of the cover 3, as well as the front boundary portion stitched to the suit 1, maintain the stronger three-layers construction; on the other hand, the front portion 5 where the three layers are replaced by the thin and light insert 10 provide optimum comfort, breathability and room for the genitals, especially for the male genitals.

The invention claimed is:

1. A cycling suit for a male user comprising:

a seat pad located in a crotch area of the suit, wherein the seat pad comprises:

a cover (3) fixed to the cycling suit, said cover (3) comprising a multi-layered structure, wherein said cover (3) has a front portion (5) located for accommodating genitals when the cycling suit is worn, the front portion (5) made of a single-layer skin contact textile, substantially symmetrical along central axis (X), and substantially surrounded by the multi-layer structure.

2. The suit according to claim 1, said cover including an intermediate layer sandwiched between an inner layer and an outer layer, the intermediate layer being made of a synthetic rubber foam.

3. The suit according to claim 2, the intermediate layer being made of a synthetic rubber foam that is perforated.

4. The suit according to claim 1, said front portion being obtained by cutting an aperture in the cover and placing an insert of skin contact textile over said aperture.

5. The suit according to claim 4, said insert being made of nylon or Lycra or polyester or a combination thereof.

6. The suit according to claim 1, said front portion having a rounded shape.

7. A seat pad for a cycling suit, the seat pad comprising:

a cover (3) fixed to the cycling suit, said cover (3) comprising a multi-layered structure, wherein said cover (3) has a front portion (5) located for accommodating genitals when the cycling suit is worn, the front portion (5) made of a single-layer skin contact textile, substantially symmetrical along central axis (X), and substantially surrounded by the multi-layer structure.

* * * * *